United States Patent [19]

Wu

[11] 4,347,309

[45] Aug. 31, 1982

[54] PHOTOSENSITIVE POLYPHOSPHATE COMPRISING AG AND CL

[75] Inventor: Che-Kuang Wu, Horseheads, N.Y.

[73] Assignee: Corning Glass Works, Corning, N.Y.

[21] Appl. No.: 237,853

[22] Filed: Feb. 25, 1981

[51] Int. Cl.[3] ..... G03C 1/02; G03C 1/52

[52] U.S. Cl. ..... 430/616; 430/564; 430/569; 430/617; 430/932; 423/305; 423/306; 423/311; 423/315

[58] Field of Search ..... 430/564, 617, 601, 616, 430/610, 569, 962, 932; 423/305, 306, 311, 315; 65/30.11

[56] References Cited

U.S. PATENT DOCUMENTS

| | | | |
|---|---|---|---|
| 637,637 | 11/1899 | Meyer | 430/564 |
| 962,788 | 6/1910 | Schwartz | 430/617 |
| 2,423,465 | 7/1947 | Murray | 430/617 |
| 3,932,189 | 1/1976 | Kaneda et al. | 430/617 |
| 4,226,628 | 10/1980 | Bartholomew et al. | 423/306 |

FOREIGN PATENT DOCUMENTS

| | | | |
|---|---|---|---|
| 39-18706 | 9/1964 | Japan | 430/610 |
| 10284 | of 1910 | United Kingdom | 430/617 |

*Primary Examiner*—Mary F. Downey
*Attorney, Agent, or Firm*—Kees van der Sterre

[57] ABSTRACT

A photosensitive material in the form of a silver and chlorine-containing polyphosphate which exhibits permanent visible darkening on exposure to ultraviolet or short wavelength visible light, is described.

3 Claims, 4 Drawing Figures

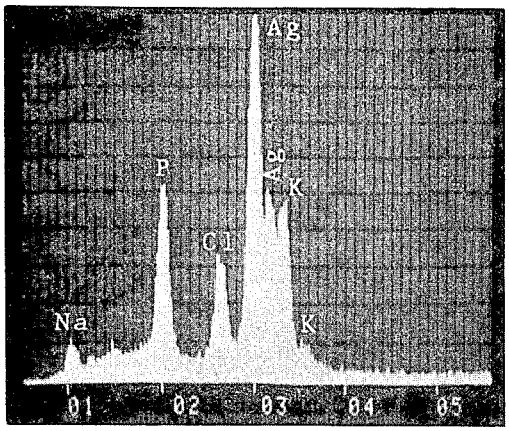
Fig. 2
Fig. 3
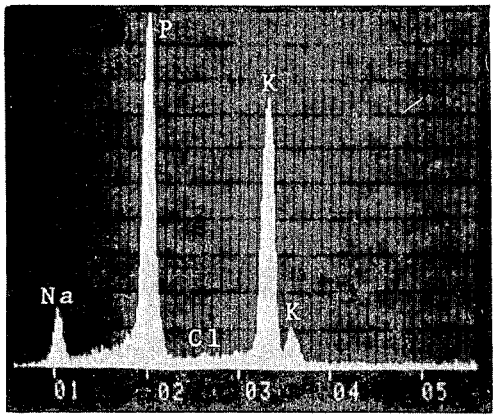

PHOTOSENSITIVE POLYPHOSPHATE COMPRISING AG AND CL

BACKGROUND OF THE INVENTION

The present invention relates generally to photosensitive materials and particularly to a novel group of polyphosphorus compounds comprising silver and chlorine which exhibit strong, permanent darkening on exposure to ultraviolet and short wavelength visible light.

The photosensitive of silver halides is well known and has long been utilized to provide photosensitive films of both emulsion and binder-free types. A background discussion of the prior art relating to silver halide emulsions and binder-free (e.g., evaporated) silver halide films for photographic applications is provided in U.S. Defensive Publication No. T966,003 to Maskasky.

It is also known that silver halide crystals can exhibit photosensitivity following encapsulation in a glassy matrix. U.S. Pat. No. 4,160,654 to Bartholomew et al. and U.S. Pat. No. 4,191,547 to Wu disclose photosensitive glasses incorporating silver halide crystals which visibly darken on exposure to ultraviolet light without any requirement for chemical or physical development.

SUMMARY OF THE INVENTION

The present invention provides a novel photosensitive material in the form of a silver and chlorine-containing polyphosphate which offers good ultraviolet and short wavelength visible darkening sensitivity in combination with good photographic resolution and image permanence. The material can be provided as a viscous liquid or wax-like solid which can readily be applied as a thin coating to the surface of a suitable support, e.g., a paper, plastic, or glass sheet. The resulting photosensitive medium is suitable for use in a direct writing or imaging mode without any need for development to intensify the written image.

The composition and structure of the novel photosensitive materials of the invention have not been fully determined, but it is postulated that the materials have a polyphosphate structure, i.e., that they comprise several phosphorus atoms per molecule. The materials are generally produced by a two-step reaction procedure involving, first, a condensation reaction between $KH_2PO_4$ and $Ag_3PO_4$ to drive off $H_2O$ and, secondly, a reaction of the resulting condensate with NaCl.

Describing the preparation procedure in more detail, the first step in forming a photosensitive product in accordance with the invention involves condensing a mixture comprising $KH_2PO_4$ and $Ag_3PO_4$ wherein these reactants are present in a weight ratio ($KH_2PO_4$-:$Ag_3PO_4$) in the range of about 50:1 to 1:1. The purpose of this step is to cause water evolution from the mixture and the formation of a liquid or solid condensation product therefrom. The condensation reaction is typically initiated and sustained by heating the mixture.

The second step of the procedure is to react the condensation product produced as described with dissolved NaCl to impart the desired photosensitivity thereto. The actual reaction involved is not known but it is believed that this step results in the formation of a phase comprising silver and chlorine in the product, which phase is believed responsible for the photosensitive effects which have been observed.

As previously noted, the photosensitive polyphosphate product of the described procedure may range in viscosity from a viscous liquid to a waxy solid, depending presumably on the chain length of the polyphosphate product. The product may be separated from the NaCl reaction medium, for example, by decantation or filtration, and may then be utilized as a coating or in any other suitable way to record optical information in the form of images or in such other form as may be desired.

BRIEF DESCRIPTION OF THE DRAWINGS

The invention may be further understood by reference to the drawings wherein:

FIG. 2 is an X-ray emission scan focusing on a particle observed in the sample of FIG. 1;

FIG. 3 is an X-ray emission scan focusing on a portion of the region surrounding the particle in the sample of FIG. 1.

DETAILED DESCRIPTION

Figure 1:
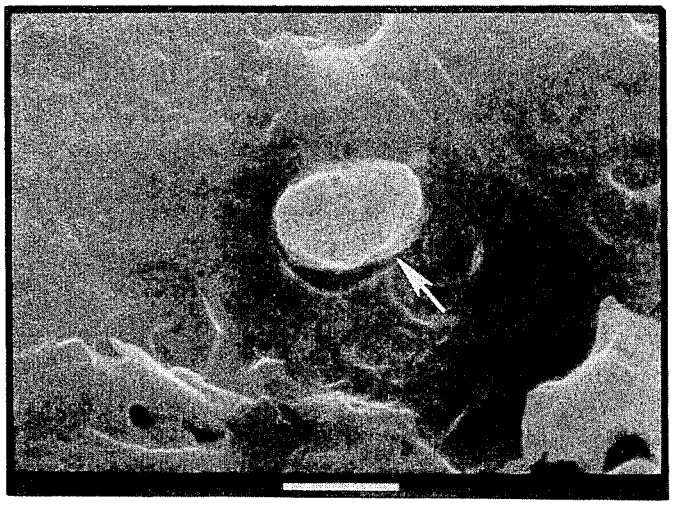
FIG. 1 is a photomicrograph of a fractured surface of a photosensitive sample provided in accordance with the invention.

Although the composition and structure of the photosensitive product of the invention are not known, it is known that water is evolved during the condensation step of the preparation procedure and that K, Na, Ag, P and Cl are present in the photosensitive product. Because the product results from condensation it is assumed that it is in a large part a polyphosphate, e.g., a sodium, potassium and/or silver salt of a long chain molecule comprising many phosphorus atoms. However, the use of the polyphosphate designation is not intended to be limiting; rather it is believed that the spirit of the invention extends to any photosensitive product, polyphosphate or otherwise, produced in accordance with the process herein described.

In a convenient form the condensation step of the process of the invention is carried out by heating a mixture of $KH_2PO_4$ and $Ag_3PO_4$, in the proper proportions, at a temperature at least sufficient to cause condensation and the evolution of water from the mixture. Typically this requires a temperature of at least about 300° C.

Normally, heating will be continued until the evolution of $H_2O$ vapor from the mixture ceases. Since the condensation reaction is both time and temperature dependent, shorter reaction times are required at higher temperatures and vice versa. For example, at 300° C. the reaction can proceed to completion within about 24 hours, while at 500° C. only about 10 minutes are required for completion.

Treatment of the condensation product produced as described with dissolved NaCl is conveniently accomplished by dispersing the condensate in a solution of NaCl in a polar solvent, such as an aqueous NaCl solution. The reaction with NaCl is desirably accelerated by heating the dispersion. Temperatures above the boiling point of the solution at standard atmospheric pressure are not required; for example, in a thorough dispersion the reaction can be substantially completed at 80° C. in less than about an hour.

Following treatment with NaCl to render the phosphate condensation product photosensitive, excess water and salt are removed and the product is then employed to provide a suitable photosensitive medium for photographic or other use. A presently preferred mode of usage is to coat a porous support such as paper with the product, removing excess material so that only a very thin film of photosensitive material remains. Since the material is sufficiently sensitive to visibly darken on exposure, e.g., to sunlight following the reaction with NaCl, it is desirable to carry out this reaction and subsequent separation and coating or similar procedures in the absence of activating light.

A photosensitive medium such as the coated paper above described exhibits high sensitivity to darkening by ultraviolet and blue light, with some sensitivity to green light and diminishing sensitivity in the red. As an illustration of the sensitivity which can be achieved, the writing energy at 365 nm needed to achieve one optical density unit of darkening in one film provided according to the invention was 4 mj/cm$^2$, about the equivalent of a 0.8-second exposure to the ultraviolet portion of bright sunlight. The darkened image resulting from such an exposure is very stable, showing no visible contrast reduction over a one-year test interval.

The invention may be further understood by reference to the following Example, offered to illustrate the preparation of an optical recording medium in accordance therewith.

EXAMPLE

A mixture consisting of 50 grams of $KH_2PO_4$ and 25 grams of $Ag_3PO_4$ is run into a crucible and the crucible and contents are placed in a box furnace operating at a temperature of 300° C. Heating at this temperature is continued for a 24-hour interval after which no further water evolution is observed. The product of this treatment is a yellowish solid.

The reacted intermediate thus provided is blended with an aqueous salt solution containing NaCl at a concentration of 0.125 gm/cc. Blending is carried out in a Model 5010 Waring® commercial blender.

In the absence of light the blended mixture is heated at 80° C. for 30 minutes to react the intermediate with the salt. Excess solution is then poured off and the product, in the form of a glue-like viscous liquid, is coated onto a sheet of conventional typing paper using a spatula. Excess amounts of the photosensitive material are removed from the paper with the spatula leaving only the pore structure filled.

To test the photosensitive response characteristics of the coated medium thus provided, a photographic test pattern about 1 cm$^2$ in size is contact-printed onto the sheet by exposing the sheet through the pattern to a 6-watt Blak-Ray® UVL-56 ultraviolet light source spaced six inches from the sheet. The exposure interval is 0.5 minutes.

Figure 4:
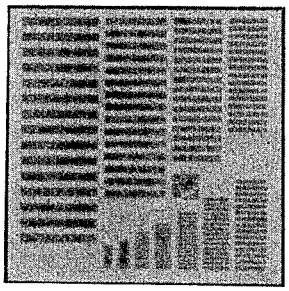
FIG. 4 shows a photographic test pattern recorded on a photosensitive medium provided in accordance with the invention.

A photographic enlargement of the contact-printed test pattern is shown in FIG. 4 of the drawing. No development is required to obtain the contrast shown in FIG. 4, although of course contrast may be lost by background darkening if the sheet is not protected from further exposure.

For many applications it may be desirable to stabilize images produced as above described against modification by further exposure to light. It has been found that the unexposed photosensitive material is significantly more soluble in certain aqueous solutions than the exposed and darkened material. It thus becomes possible to fix the darkened image through a simple washing process. Aqueous thiosulfate solutions constitute a suitable medium for removing unexposed material from a support.

The performance of the above described medium suggests the utility of these photosensitive products for a number of applications where direct writing capability is advantageous. Examples of such applications include computer output microfilm, photomasks for blue light or ultraviolet photoresist processes, and archival optical recording.

Scanning electron microscopes and X-ray emission studies undertaken to elucidate the structure of a solid photosensitive material provided in accordance with the invention suggest that these materials are typically amorphous but with at least some small, particulate, possibly crystalline inclusions. Whether these particles are responsible for some of the photosensitive effects observed could not be determined.

FIG. 1 of the drawing is an electron photomicrograph taken of a sample of a material provided in accordance with the procedure of the above Example, taken at an enlargement of 20,000 diameters, wherein one of the particulate inclusions is indicated by a white arrow. The white bar in the micrograph represents a dimension of one micron.

An X-ray emission scan focusing on the particle shown in FIG. 1 is provided as FIG. 2 of the drawing. That scan suggests the presence of substantial concentrations of Ag and Cl, in addition to some P, K and Na, the Ag and Cl concentrations in the particle greatly exceeding the concentrations of these elements found in the immediately surrounding material. An X-ray emission scan of the latter is provided as FIG. 3 of the drawing, that scan suggesting the presence of major amounts of phosphorus, intermediate amounts of potassium, minor amounts of sodium and trace amounts of chlorine, but no detectable silver, in the region surrounding the particle of FIG. 1.

It was noted that the X-ray spot used to generate the data of FIGS. 2 and 3 was relatively large (1–3 μm) in comparison with the particle indicated in FIG. 1. Thus some of the signal recorded in FIG. 2 may be due to background. Nevertheless the overall X-ray emission spectrum of the material shown in FIG. 1 suggested the presence of substantially higher quantities of Ag and Cl than could be accounted for by the very few particles of the FIG. 1 type which were observed. It was therefore concluded that other undetected particulate or otherwise segregated phases rich in Ag and Cl were present in the sample.

I claim:

1. A photosensitive polyphosphate comprising Ag and Cl which is produced by:

(a) condensing a mixture comprising $KH_2PO_4$ and $Ag_3PO_4$ in weight ratio ($KH_2PO_4$:$Ag_3PO_4$) in the range of about 50:1 to 1:1 to cause water evolution and the formation of a solid or liquid condensation product therefrom; and (b) reacting the condensation product of (a) with dissolved NaCl to provide a photosensitive polyphosphate product.

2. A method of making a photosensitive material which comprises the steps of reacting $KH_2PO_4$ with $Ag_3PO_4$ in proportions of 1–50 parts $KH_2PO_4$ for each part $Ag_3PO_4$ by weight to cause water evolution and the formation of a solid or liquid condensation product therefrom, and reacting the condensation product with dissolved NaCl to provide a photosensitive polyphosphate product.

3. A photosensitive medium comprising a coating of a photosensitive polyphosphate on a support, wherein the photosensitive polyphosphate is produced by: (a) condensing a mixture comprising $KH_2PO_4$ and $Ag_3PO_4$ in a weight ratio ($KH_2PO_4$:$Ag_3PO_4$) in the range of about 50:1 to 1:1 to cause water evolution and the formation of a solid or liquid condensation product therefrom, and (b) reacting the condensation product with dissolved NaCl to provide a photosensitive polyphosphate product.

* * * * *